United States Patent [19]

Ponce, Jr.

[11] Patent Number: 4,629,943

[45] Date of Patent: Dec. 16, 1986

[54] LONG LIFE TRAFFIC CONTROL LAMP AND SOCKET INSERT

[76] Inventor: Emiliano Ponce, Jr., 3715 Maple Rd., Alderwood Manor, Wash. 98037

[21] Appl. No.: 616,492

[22] Filed: Jun. 1, 1984

[51] Int. Cl.[4] ..... H05B 37/00; H05B 39/00; H05B 41/14

[52] U.S. Cl. ..... 315/200 R; 313/318; 315/51; 315/71

[58] Field of Search ..... 315/51, 52, 53, 71, 315/200 R; 340/931; 250/365; 313/318

[56] References Cited

U.S. PATENT DOCUMENTS

| | | | |
|---|---|---|---|
| 3,818,263 | 6/1974 | Belko | 315/71 X |
| 3,836,814 | 9/1974 | Rodriquez | 315/51 |
| 3,869,631 | 3/1975 | Anderson et al. | 315/71 X |
| 4,435,671 | 3/1984 | Wouk | 315/71 X |

*Primary Examiner*—Saxfield Chatmon
*Attorney, Agent, or Firm*—Seed & Berry

[57] ABSTRACT

A long-life incandescent lamp and a socket insert for use with conventional lamps to provide long life. The lamp includes a sealed glass envelope, a base fixedly attached to the glass envelope, a center contact fixedly attached to the base and electrically insulated therefrom, a pair of lead wires extending within the envelope, an illuminable filament disposed within the envelope and electrically connected between the lead wires, a diode electrically connected between the center contact and the one lead wire for half-wave rectifying current to the filament, and a resistor for providing a resistive bridge between the base and center contact. The resistor has a resistance substantially in excess of the resistance of the filament, preferably no greater than 27K ohms. In one embodiment, the resistor is electrically connected between the center contact and the base in parallel with the in-series combination of the filament and the diode. In another embodiment, the resistor is electrically connected between the anode and the cathode of the diode in series with the diode. An alternative embodiment is a socket insert for use with an incandescent lamp having a center base contact and operating on alternating current. The insert includes a support body positionable within a lamp socket between the lamp and the center contact of the socket, with a diode and a resistor connected in parallel therebetween.

13 Claims, 3 Drawing Figures

LONG LIFE TRAFFIC CONTROL LAMP AND SOCKET INSERT

DESCRIPTION

1. Technical Field

The present invention relates generally to traffic control lamps, and more particularly, to a long-life incandescent traffic control lamp and a socket insert for use with a conventional traffic control lamp that will function with solid state electronic traffic controllers having conflict monitors.

2. Background Art

Whenever a traffic control lamp used in stop lights and other traffic control devices burns out or otherwise needs replacement, a maintenance crew must be dispatched to replace the lamp. The cost involved in changing such a lamp far exceeds the value of the lamp itself, often requiring lifting equipment to lift personnel to the traffic signal which may be far above the street level, and the services of several persons to operate the lift, change the lamp, and direct traffic. During the time period when the traffic control lamp is inoperative, traffic congestion and confusion of drivers and pedestrians may occur and an accident may result. Until the maintenance crew arrives and the traffic control lamp is replaced, the services of traffic police are many times required, placing a burden on the police department. If the life of the traffic control lamp can be extended and fewer replacements required, substantial savings will be realized and traffic flow will not be interrupted so frequently due to inoperative lamps.

It is well known that the use of a diode in series with the filament of an incandescent lamp operated on alternating current significantly increases the life of the lamp, only requiring an increase in the lamp's wattage rating to produce a lumen output equivalent to the lamp previously used. The diode provides half-wave rectified direct current to the lamp filament.

One approach to using a diode with a lamp is to install the diode in a disc-shaped support which is positionable within the lamp socket with one contact surface in electrical contact with the center contact of the socket and another contact surface in electrical contact with the center contact of the lamp. The diode is positioned within the diode disc and is connected between the two contact surfaces. To facilitate proper alignment of the diode disc contact surfaces with the lamp and socket center contacts, the disc is sometimes provided with an adhesive which may be used to glue the disc to the base of the lamp and allows the disc to travel with the lamp as it is screwed into the socket.

Another approach is illustrated in U.S. Pat. No. 3,869,631, in which a diode is mounted within the lamp between the lamp base and the stem press of the lamp, external of the gas-filled glass envelope containing the lamp filament.

The use of such a diode disc or lamp will extend the life of a traffic control lamp; however, it has been found that the addition of the diode causes solid state electronic traffic controllers having conflict monitors to malfunction and indicate an error condition. When an error condition is indicated, the traffic controller for a stop light enters a conflict mode and automatically switches a red or yellow flashing signal to the entire intersection.

It will therefore be appreciated that there has been a need for a long-life incandescent traffic control lamp and for a socket insert which may be used with conventional traffic control lamps to provide long life, but which are operable with solid state electronic traffic controllers having conflict monitors. The traffic control lamp and socket insert should provide for extended lamp life with minimal energy loss, should be inexpensive to manufacture, and should use readily available components without unduly high power rating requirements. The present invention fulfills this need and further provides other related advantages.

DISCLOSURE OF THE INVENTION

The present invention resides in a long-life incandescent lamp and a socket insert for use with conventional lamps to provide long life. The lamp includes a sealed glass envelope, a first electrical contact external of the glass envelope, a second electrical contact external of the glass envelope and electrically insulated from the first contact, an illuminable filament disposed within the glass envelope and electrically connected between the first and second contacts, a rectifier means for rectifying current to the filament, and a resistive means for providing a resistive bridge between the first and second contacts. The resistive means has a resistance substantially in excess of the resistance of the filament.

More specifically, one of the first or second contacts is a base fixedly attached to the glass envelope and sized to be received in a socket, while the other of the first or second contacts is a center contact fixedly attached to the base and electrically insulated therefrom. A pair of lead wires extend within the glass envelope and the filament is electrically connected between the lead wires. The rectifier means is a diode electrically connected between one of the pair of lead wires and one of the base or center contacts in series with the filament, with the other one of the pair of lead wires being electrically connected to the other one of the base or center contacts. The resistive means is a resistor.

In one embodiment of the invention, the resistor is electrically connected between the center contact and the base in parallel with the in-series combination of the filament and the diode. In another embodiment of the invention, the resistor is electrically connected between the anode and the cathode of the diode in parellel with the diode. When used with presently available solid state electronic traffic controllers, the resistor has a resistance of no greater than 27 K ohms. The diode rectifies the alternating current to provide a direct drive current to the filament to improve lamp life, and the resistor provides a low-current electrical bypass of the diode to avoid indication of an error condition by the conflict monitor.

An alternative embodiment of the invention is a socket insert for use with a conventional incandescent lamp having a center base contact and operating on alternating current in order to extend the life of the lamp. The insert includes a support body positionable within a lamp socket between the incandescent lamp and the center contact of the socket. The support body has a first contact for electrical contact with the center contact of the lamp and a second contact for electrical contact with the center contact of the socket. A diode is electrically connected between the first and second contacts, and a resistive element is also electrically connected between the first and second contacts in parallel with the diode.

Other features and advantages of the invention will become apparent from the following detailed description, taken in conjunction with the accompanying drawings.

BEST MODE FOR CARRYING OUT THE INVENTION

Figure 1:
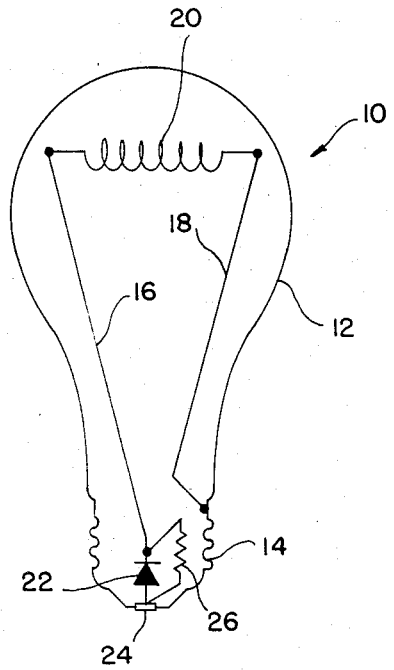
FIG. 1 is a schematic drawing of an incandescent lamp embodying the present invention.

As shown in the drawings for purposes of illustration, the present invention is embodied in an incandescent lamp, indicated generally by reference numeral 10. The lamp 10 includes a sealed glass envelope 12, a metallic screw base 14 fixedly attached to the lower end of the glass envelope, a pair of lead wires 16 and 18, and an illuminable filament 20 disposed within the glass envelope and connected between the lead wires. Except as will be described thereinafter, the lamp is of conventional and well known design, and will not be described or shown in detail herein. One such incandescent lamp is shown and described in U.S. Pat. No. 3,869,631, incorporated herein by reference.

In conventional manner, the lead wire 18 is connected directly to the base 14. The other lead wire 16 is connected to the cathode of a diode 22, and the anode of the diode is connected to a center contact 24 of the base 14. The center contact 24 is fixedly attached to the base 14 and electrically insulated therefrom.

When the lamp 10 is screwed into a socket (not shown), the center contact of the socket engages and makes electrical contact with the center contact 24 of the lamp 10, and the base 14 engages and makes electrical contact with the correspondingly threaded portion of the socket. With alternating current provided to the lamp 10 through the socket, the diode 22 rectifies the current to the filament 20 to produce a half-wave rectified direct current and provide the long-life characteristic of the lamp.

In accordance with the present invention, the lamp 10 also includes a bypass resistor 26 electrically connecting the center contact 24 with the lamp base 14. In the embodiment of the invention shown in FIG. 1, the bypass resistor 26 is electrically connected between the anode and the cathode of the diode 22 in parallel with the diode. In the alternative embodiment of the invention shown in FIG. 2, the bypass resistor 26 is connected in parallel with the in-series combination of the filament 20 and the diode 22. The bypass resistor 26 and the diode 22 are positioned within the lamp 10, external of the sealed glass envelope 12 containing the heated filament 20.

In both embodiments, the bypass resistor 26 has a resistance substantially in excess of the resistance of the filament 20 and provides a low-current bypass of the diode 22. In such fashion, the conflict monitor sensing circuits of the traffic controller with which the lamp 10 is used will sense a current path through the lamp 10 at all times. The bypass resistor 26 provides a continuous electrical path to the conflict monitor which is necessary to avoid the monitor indicating a specious error condition and entering a conflict mode. The current flow through the bypass resistor 26 when the diode 22 is back-biased will be at a substantially lower level than the current through the diode and filament when the diode is forward-biased with a drive current supplied to the filament.

It has been found that with many of the solid state electronic traffic controllers, a lamp 10 with a fixed resistance for the bypass resistor 26 of approximately 22 K to 27 K ohms or less will operate satisfactorily and avoid malfunctioning of the traffic controller. The bypass resistor 26 should be selected with as high a resistance value as will operate satisfactorily with the traffic controller with which the lamp 10 is used to avoid any unnecessary dissipation of energy during the portion of the alternating current cycle when the diode 22 is reverse-biased.

Figure 2:
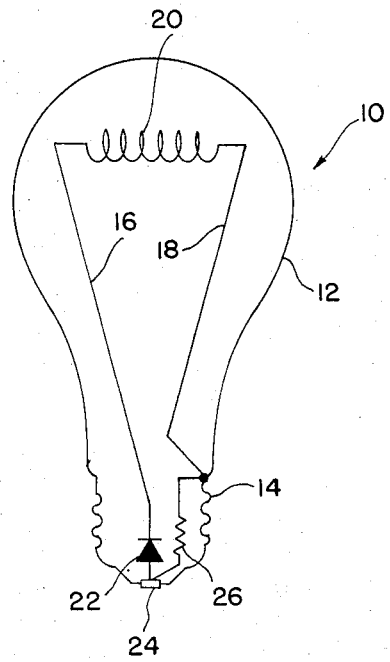
FIG. 2 is a schematic drawing of an alternative embodiment of the lamp shown in FIG. 1.

In the embodiment shown in FIG. 1, the diode 22, and in the embodiment shown in FIG. 2, the in-series combination of the diode 22 and the filament 20, have relatively low resistance and effectively short-circuit the bypass resistor 26 when the diode is forward-biased to supply a drive current to the filament.

It is noted that while the lamp 10 has been described as a traffic control lamp, the lamp of the present invention may be used in other situations, such as a security light monitored by a sensing circuit which will not function when a diode is used in the conventional manner to achieve long life for the lamp. It is also noted that the orientation of the diode 22 may be reversed or the diode may be connected between the lead wire 18 and the base 14, while still achieving the benefit of the present invention. Although an arrangement is shown and described using a single diode 22 for half-wave rectification, the present invention may be used when the alternating current powering the lamp is rectified to a greater or lesser extent.

The bypass resistor 26 of the present invention may be a resistor of fixed value or may have the necessary resistance supplied by a variable resistor or other device having a resistive element, such as a thermistor. The bypass resistor 26 and the diode 22 may be fabricated as discrete components, as an integrated circuit, or otherwise. Of course, the bypass resistor 26 can be produced by a combination of resistive elements in series or parallel producing the desired resistance.

With the present invention, the bypass resistor 26 may be a discrete component of conventional design and will typically have a standard power rating which makes the component readily available and inexpensive. Using an alternating current with a line voltage of 110 volts and a resistance of 22 K ohms for the bypass resistor 26, the maximun power dissipated by the resistor is only slightly in excess of one-half watt.

While the lamp 10 of the present invention has been shown and described with the diode 22 and the bypass resistor 26 positioned within the lamp, the diode and bypass resistor may be located at any desirable location within or outside of the lamp, as dictated by manufacturing economics or design choice.

Figure 3:
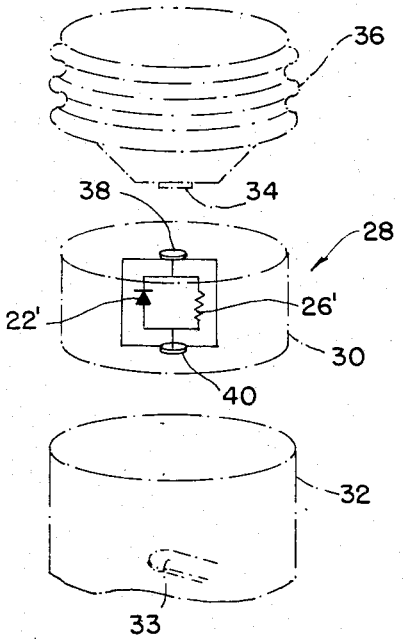
FIG. 3 is a schematic drawing of a socket insert embodying the present invention for use with a conventional incandescent lamp, showing the insert position between the base of a lamp and a lamp socket prior to placement of the insert within the socket.

Another alternative embodiment of the invention is shown in FIG. 3 and includes a socket insert, indicated generally by reference numeral 28. The insert 28 has a support body 30 with a disc shape sized for insertion into a lamp socket 32. The insert 28 is positioned within the socket 32 between a center contact 33 of the socket and a center contact 34 of a conventional lamp 36.

The insert 28 is provided with a first contact surface 38 positioned on one face of the disc body 30 for engagement and electrical contact with the center contact 34 of the lamp 36, and a second contact surface 40 positioned on the opposite face of the disc body for engagement and electrical contact with the center contact 33 of the socket 32. Electrically connected in parallel between the first and second contact surfaces 38 and 40 is a diode 22' and a bypass resistor 26'. As described above for the first two embodiments of the invention, the bypass resistor 26' provides a continuous electrical path through the lamp 36 even when the diode 22' is reverse-biased to prevent the traffic controller with which the conventional lamp 36 is being using from indicating an error condition and entering a conflict mode.

It will be appreciated, that although specific embodiments of the invention have been described herein for purposes of illustration, various modifications may be made without departing from the spirit and scope of the invention. Accordingly, the invention is not limited except as by the appended claims.

I claim:

1. A long-life incandescent traffic control lamp for use with a traffic controller having a conflict monitor, the traffic controller having a first state during which alternating current drive power is supplied to the lamp for illumination and a second state during which the drive power to the lamp has been removed, comprising a sealed glass envelope having an illuminable filament disposed therein and electrically connected between a lamp base and a lamp center contact, said electrical connection of said filament between said base and said center contact being through a diode, said diode being bridged by a resistive element, said resistive element having a resistance sufficiently high to provide at least a low-current electric circuit bypass of said diode during the second state of the traffic controller when the drive power to the lamp has been removed to prevent the conflict monitor from falsely tripping, while providing substantially no illuminating lamp drive current to said filament during the first state of the traffic controller when the drive power has been supplied to the lamp for illumination, whereby said diode rectifies the lamp drive current to said filament to improve lamp life when the drive power is supplied while said resistive element provides a low-current electrical bypass of said diode to avoid indication of an error condition by the conflict monitor when the drive power is removed.

2. The traffic control lamp of claim 1 wherein said resistive element has a resistance substantially in excess of the resistance of said filament.

3. The traffic control lamp of claim 1 wherein said resistive element bridges said diode by being electrically connected between said center contact and said base.

4. The traffic control lamp of claim 1 wherein said resistive element bridges said diode by being electrically connected between the anode and the cathode of said diode.

5. A long-life incandescent traffic control lamp for use with a traffic controller having a conflict monitor, the traffic controller having a first state during which alternating current drive power is supplied to the lamp for illumination and a second state during which the drive power to the lamp has been removed, comprising:

a sealed glass envelope;

a base fixedly attached to said envelope and sized to be received in a socket;

a contact fixedly attached to said base and electrically insulated therefrom;

a pair of lead wires extending within said envelope;

an illuminable filament disposed in said envelope and electrically connected between said pair of lead wires;

a diode electrically connected in series with said filament; and a resistive element electrically connecting said base with said contact and bypassing said diode, said resistive element having a resistance sufficiently high to provide at least a low-current electric circuit bypass of said diode during the second state of the traffic controller when the drive power to the lamp has been removed to prevent the conflict monitor from falsely tripping, while providing substantially no illuminating lamp drive current to said filament during the first state of the traffic controller when the drive power has been supplied to the lamp for illumination.

6. The lamp of claim 5 wherein said resistive element electrically connects the anode to the cathode of said diode in parallel therewith.

7. The lamp of claim 5 wherein said resistive element is electrically connected in parallel with the in-series combination of said filament and said diode.

8. The lamp of claim 5 wherein said resistive element has a resistance of no greater than 27 K ohms.

9. A socket insert for use with an incandescent traffic control lamp having a center base contact and operating on alternating current drive powr to extend the life of the lamp, the lamp being positionable in a lamp socket with a center contact and being usable with a traffic controller having a conflict monitor, the traffic controller having a first state during which alternating current power drive is supplied to the lamp for illumination and a second state during the which the drive power to the lamp has been removed, comprising:

a support body positionable within the lamp socket between the incandescent lamp and the center contact of the socket, said support body having a first contact for electrical contact with the center contact of the lamp and a second contact for electrical contact with the center contact of the socket;

a diode electrically connected between said first and second contacts; and a resistive element electrically connected between said first and second contacts in parallel with said diode, said resistive element having a resistance sufficiently high to provide at least a low-current electric circuit bypass of said diode during the second state of the traffic controller when the drive power to the lamp has been removed to prevent the conflict monitor from falsely tripping, while providing substantially no illuminating lamp drive current to said filament during the first state of the traffic controller when the drive power has been supplied to the lamp for illumination.

10. A long-life incandescent traffic control lamp for use with a traffic controller having a conflict monitor, the traffic controller having a first state during which alternating current drive power is supplied to the lamp for illumination and a second state during which the drive power to the lamp has been removed, comprising:

a sealed glass envelope;

a first electrical contact external of said glass envelope;

a second electrical contact external of said glass envelope and electrically insulated from said first contact;

an illuminable filament disposed within said glass envelope and electrically connected between said first and second contacts;

rectifier means for rectifying current to said filament; and resistive means for providing a resistive bridge between said first and second contacts and bypassing said rectifer means, said resistive means having a resistance sufficiently high to provide at least a low-current electric circuit bypass of said rectifier means during the second state of the traffic controller when the drive power to the lamp has been removed to prevent the conflict monitor from falsely tripping, while providing substantially no iluminating lamp drive current to said filament during the first state of the traffic controller when the drive power has been supplied to the lamp for illumination.

11. The traffic lamp of claim 10 wherein said rectifier means is a diode electrically connected in series with said filament between said filament and one of said first or second contacts.

12. The traffic lamp of claim 11 wherein said resistive means is a resistor electrically connected between the anode and the cathode of said diode.

13. The traffic lamp of claim 11 wherein said resistive means is a resistor electrically connected between said first and second contacts in parallel with the in-series combination of said filament and said diode.

* * * * *